United States Patent [19]

Kobayashi et al.

[11] 4,090,331

[45] May 23, 1978

[54] APPARATUS FOR PREVENTING CIRCUMFERENTIAL OVERSPEEDING OF A GRINDING WHEEL

[75] Inventors: Akiyoshi Kobayashi; Yukihiro Nakayama, both of Kariya, Japan

[73] Assignee: Toyoda-Koki Kabushiki-Kaisha, Japan

[21] Appl. No.: 797,616

[22] Filed: May 17, 1977

[30] Foreign Application Priority Data

Jun. 23, 1976 Japan ..... 51-74103

[51] Int. Cl.[2] ..... B24B 47/18

[52] U.S. Cl. ..... 51/134.5 R

[58] Field of Search ..... 51/134.5 R, 269

[56] References Cited

U.S. PATENT DOCUMENTS

| | | | |
|---|---|---|---|
| 2,171,799 | 9/1939 | Kline | 51/134.5 R UX |
| 3,656,262 | 4/1972 | Kikuchi | 51/134.5 R |
| 3,673,741 | 7/1972 | Korde | 51/134.5 R |

*Primary Examiner*—Harold D. Whitehead
*Attorney, Agent, or Firm*—Oblon, Fisher, Spivak, McClelland & Maier

[57] ABSTRACT

An apparatus for preventing circumferential overspeeding of a grinding wheel is provided in which a first rejection pin, opposed to the circumferential surface of the grinding wheel, is linked with a second rejection pin through a link mechanism. A slide plate, guided by a cover device for covering a pulley belt connection portion, is engaged with the second rejection pin to be moved therewith radially of a first or second drive pulley being alternatively mounted on a drive motor. When the first rejection pin is manipulated from the forward end to the retraction end of a slot, prior to the mounting of a fresh grinding wheel, the slide plate moves a restraining pin provided thereon into a space to be occupied by the second drive pulley, larger than the first one, so that the fresh grinding wheel can be prevented from being driven by means of the second pulley.

8 Claims, 4 Drawing Figures

APPARATUS FOR PREVENTING CIRCUMFERENTIAL OVERSPEEDING OF A GRINDING WHEEL

BACKGROUND OF THE INVENTION

1. Field of the Invention

The present invention relates to an apparatus for preventing a grinding wheel from rotating at an excessive circumferential speed, more than a predetermined speed, due to an improper selective use of belt pulleys.

2. Description of the Prior Art

In grinding technology, generally, a motor pulley on a motor axis is exchanged with a reserved motor pulley having a large diameter, thereby to recover a circumferential speed of a grinding wheel when the same wears to one-half of its useable range. However, unless the motor pulley held in reserve is exchanged with the previously used motor pulley having a small diameter when the grinding wheel wears beyond the useable or tolerable range and is to be exchanged with a fresh grinding wheel, it results that the fresh grinding wheel is rotated at an excessive speed more than a predetermined speed. An apparatus for preventing circumferential overspeeding of a grinding wheel is well known in which only a small motor pulley can be attachable to a drive motor while a grinding wheel with a large diameter, such as a fresh grinding wheel, is being mounted upon a wheel spindle, and such an apparatus has already been applied to a universal type grinding machine in which a grinding wheel is attachable to both ends of a wheel spindle.

Such an apparatus for the universal grinding machine is provided at both sides of the wheel head with pivotal arms having rejection pins which are respectively opposed to the grinding wheel and the motor pulley. However, the arms are somewhat extended to present the rejection pins into such positions as to respectively closely face the grinding wheel and the motor pulley and, when pivoted, they effect long distance movements on the rejection pins. For this reason, the apparatus is inadequate in mechanism to the harmonization with the pulley cover assembly and raises a problem in accommodating the arms within the pulley cover assembly. Especially, as long as a closed type pulley cover assembly is employed, which is closed also at its inside portion facing one side of the wheel head, the foregoing known apparatus for preventing circumferential overspeeding of a grinding wheel cannot be utilized in coexistence therewith.

SUMMARY OF THE INVENTION

It is therefore an object of the present invention to provide an improved apparatus for preventing circumferential overspeeding of a grinding wheel which is simple in construction, is reliable in operation and has good harmonization with a cover device for a pulley-belt connection portion.

Another object of the invention is to provide an improved apparatus, as above, which cooperates with a closed type cover device which is closed also at an inside portion facing one lateral portion of a wheel head.

A further object of the invention is to provide an improved apparatus, as above, applicable to a universal type grinding machine, in which a grinding wheel can be mounted on any one of the ends of a wheel spindle in a complemental relationship with a cover device attachable to any one of the lateral portions of a wheel head.

Briefly, according to the present invention, there is provided an apparatus for preventing circumferential overspeeding of a grinding wheel, which comprises a cover device for a pulley-belt connection portion, a slide plate guided by the cover device slidable radially of the first and second drive pulleys being alternatively mounted on a drive motor, a first member perforated through a slot extended radially of the grinding wheel to be opposed to the circumferential surface of the grinding wheel, a second member engaged with the slide cover to be moved therewith, a link mechanism for linking the first member with the second member, and a restraining pin provided upon the slide plate.

The slot defines retraction and forward positions thereon, which correspond respectively to first and second diameters of a grinding wheel useable therein. When the first member is retracted from the forward position to the retracting position, the restraining pin is moved into such a space as to be occupied by the second drive pulley larger than the first one, so that the drive motor will have the first pulley mounted thereon, to prevent a fresh grinding wheel with the first diameter from overspeeding.

BRIEF DESCRIPTION OF THE DRAWINGS

Various other objects, features and attendant advantages of the present invention will be readily appreciated as the same becomes better understood from the following detailed description when considered in connection with the accompanying drawings, wherein like reference numerals designate like or corresponding parts throughout the several views, and in which.

DETAILED DESCRIPTION OF A PREFERRED EMBODIMENT

Figure 1:
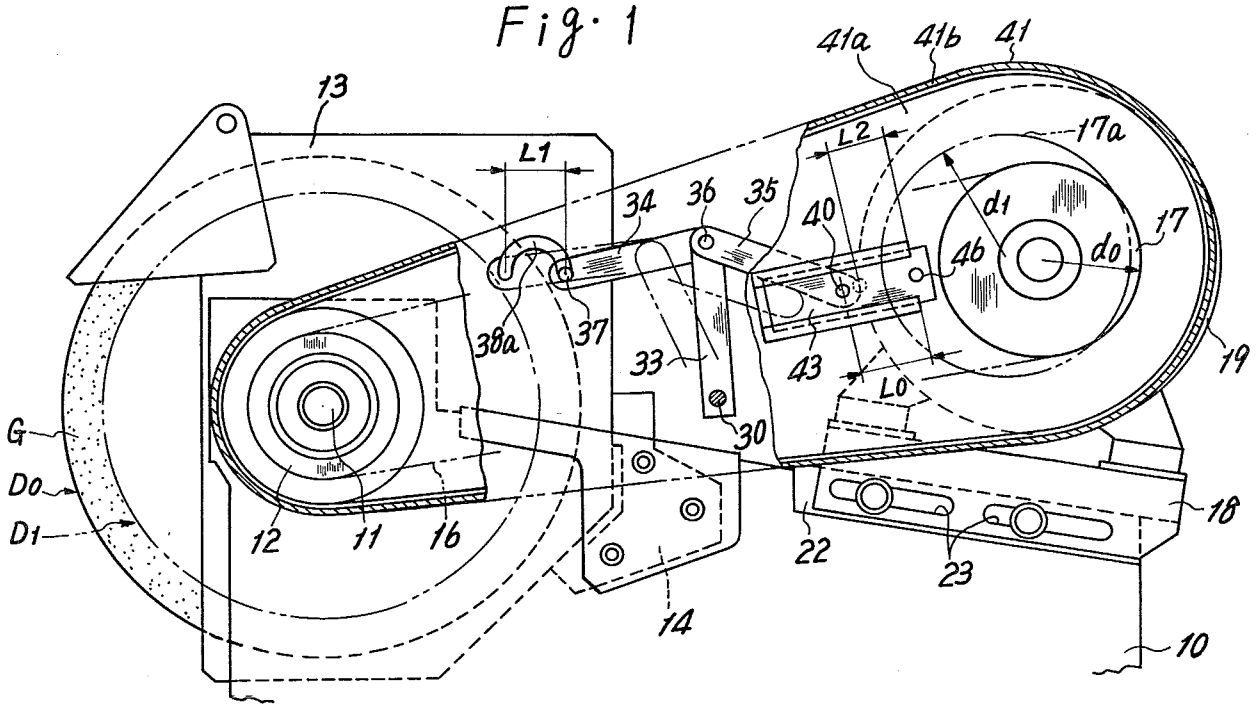
FIG. 1 is a side elevational view, partly in section, of a wheel head of a universal grinding machine on which an apparatus according to the present invention is mounted.
Figure 2:
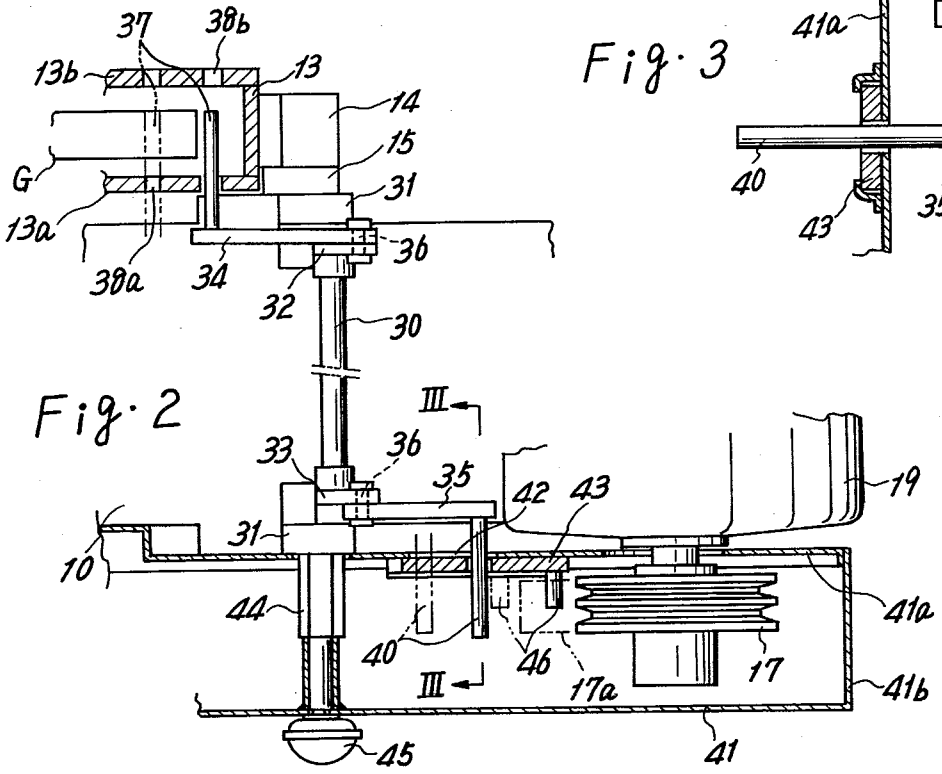
FIG. 2 is a plan view of an important portion of the apparatus shown in FIG. 1.

As illustrated in FIGS. 1 and 2, a wheel head 10 of a universal grinding machine has a wheel spindle 11 rotatably journalled thereby, upon both ends of which a grinding wheel G and a driven pulley 12 are mutually replaceably mounted. A wheel guard device or assembly 13 is attachable to any one of the lateral or side surfaces of the wheel head 10, corresponding to the mounting position of the grinding wheel G, and, in the illustrations, is bolted on the left side surface of the wheel head 10 by the use of a mounting bracket 14 and of a spacer 15. The driven pulley 12, mounted upon the right end of the wheel spindle 11, is drivingly connected with a drive pulley 17 via belts 16, and this pulley and another drive pulley **17*a*, different thereto in diameter for alternative use, are selectively attachable to an output shaft of an electric motor 19 which is fixedly mounted upon a motor base 18**.

The motor base 18 is slidable along a reference surface 22 formed at the rear-right portion of the wheel head 10. In order to adjust the tension of the belts 16, the base 18 is moved together with the electric motor 19 in a transversal direction of the wheel spindle 11 and, at that adjusted position, is fixed by means of bolts which are penetrated through elongated holes 23.

A connecting shaft 30 is rotatably supported by a pair of support blocks 31, 31 (FIG. 2) and is extended in parallel relation with the wheel spindle 11 at an intermediate position between the wheel spindle 11 and the electric motor 19. Upon both ends of the shaft 30, a pair of connecting links 32 and 33 are secured at respective ends thereof, and upon the other ends, a pair of floating links 34 and 35 are pivotably hinged by pivots 36, 36. From the free end of one of the floating links 34, a first rejection pin 37 is protruded in a direction of the wheel width and is extended into the wheel guard device or assembly 13 through a positioning guide slot 38*a*, which is formed to open on a right lateral plate 13*a* of the wheel guard assembly 13, so as to be opposed to the circumferential surface of the grinding wheel G. It is noted that, in this condition of use, in which the grinding wheel G is being mounted upon the left end of the wheel spindle 11, a left lateral plate 13*b* of the wheel guard assembly 13 can be removed for a wheel exchange.

The positioning guide slot 38*a* has forward and retracting extreme ends in the radial direction of the grinding wheel G, and with this arrangement, the rejection pin 37, when held at the retraction extreme end or a first limited position, permits the grinding wheel G, with a useable maximum diameter (first diameter) DO, to be mounted upon the wheel spindle 11. On the other hand, when the grinding wheel G is reduced to an intermediate diameter, or the second diameter D1, which requires increasing the rotational speed of the grinding wheel G, the rejection pin 37 can be adjusted to the forward extreme end of the slot 38*a* or a second limited position.

Figure 3:
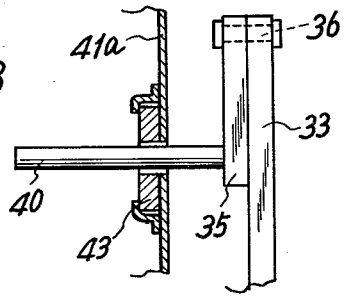
FIG. 3 is a fragmental sectional view taken along the line III—III of FIG. 2.

From the free end of the other floating link 35, a second rejection pin 40 is protruded in parallel with the axis of the wheel spindle 11 and, as more clearly indicated in FIG. 3, is penetrated through an engaging hole of a slide cover plate 43, which is overlapped with an elongated hole 42 formed on the pulley cover assembly 41. This elongated hole 42 and cover plate 43 are respectively formed on and guided by an inner cover 41*a* and are disposed almost on a line which connects the driven pulley 12 with the drive pulley 17 when the pulley cover assembly 41 is being attached. The pulley cover assembly 41 comprises the inner cover 41*a* and an outer cover 41*b* mating therewith and is of a so-called closed type, in which openings are provided on the inner cover 41*a* only at such portions as to correspond to the pulleys 12, 17 and a mounting rod 44. With this arrangement, the pulley cover assembly 41 is supported by the mounting rod 44, which is disconnectably screwed on one of the support blocks 31, 31, and is fixed by means of a knob 45 threadedly engaged with the mounting rod. The mounting rod 44 is able to be screwed also at a corresponding position of the other support block 31 so as to position the cover assembly 41 at the left side of the wheel head 10.

A restraining pin 46 is provided on the slide cover plate 43 at such a position as to be rearwardly spaced a predetermined distance Lo from the engaging hole and is protruded in a direction of the width of the drive pulley 17 so as to be opposed to the circumferential surface of the drive pulley 17. As mentioned previously, this drive pulley 17 is exchangeable with the drive pulley 17*a*, having a diameter d1 larger than that of the pulley 17, for alternaive use, and the diameter d1 of the drive pulley 17*a* is so determined that a circumferential speed at which the drive pulley 17*a* rotates a grinding wheel G with a diameter D1 coincides with that speed at which the drive pulley 17 rotates a grinding wheel G with the diameter D0. The restraining pin 46 is advanced into a space occupied by the drive pulley 17*a*, namely into the interference area with the same when the first rejection pin 37 is held at the first limited position or the rear extreme end of the positioning guide slot 38*a*.

Accordingly, when the diameter of the grinding wheel G is more than D1, the first rejection pin 37 is held at the first limited position, and the drive pulley 17*a* with the large diameter *d*1 is forbidden to be mounted on the motor axis by the restraining pin 46 being advanced within a space which the drive pulley 17*a* occupies. However, when the diameter of the grinding wheel G becomes less than D1, the first rejection pin 37 is manually moved by a distance L1 by an operator and is held at the second limited position. This movement of the pin 37 causes, through the links 34, 32, the connecting shaft 30 to pivot, and further causes, through the links 33, 35, the second rejection pin 40 to shift forwardly from a position as indicated by the solid line in FIG. 2 to a position as indicated by the dotted line. As a result, the restraining pin 46 is forwardly moved by the distance L2, together with the slide cover plate 43, so as to retract from such a space for the mounting of the drive pulley 17*a*. Therefore, when the diameter of the grinding wheel G diminishes less than D1, the drive pulley 17*a* with the large diameter d1 can be mounted on the motor axis and operates to increase the rotational speed of the grinding wheel G, so that the circumferential speed is maintained at a predetermined value.

Figure 4:
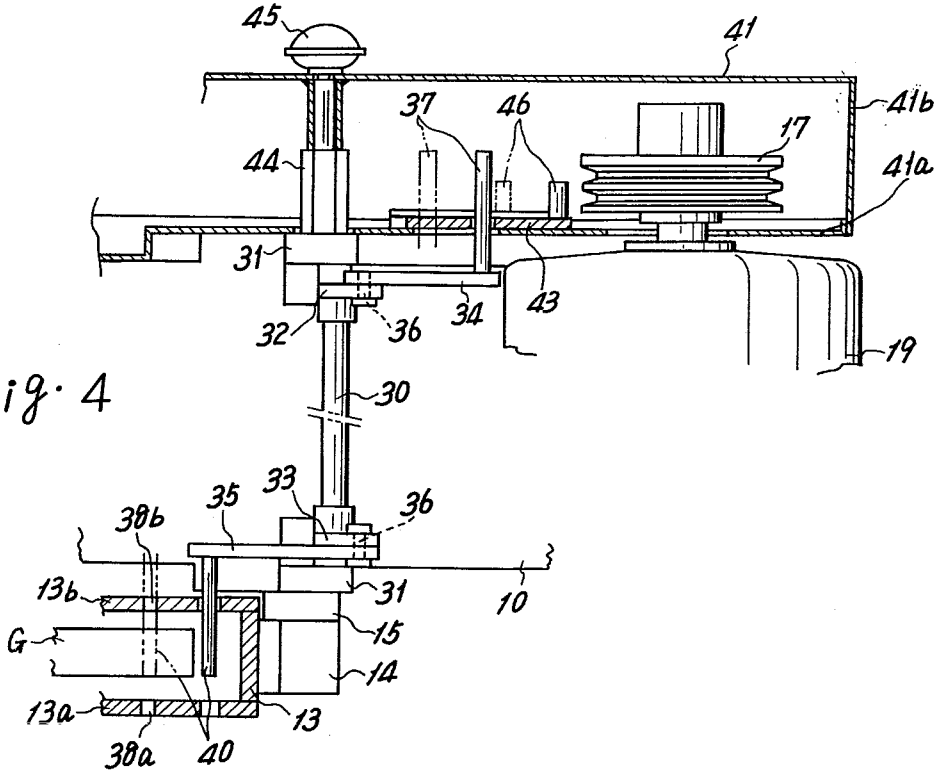
FIG. 4 is a plan view of the important portion of the apparatus illustrated in FIGS. 1 and 2, particularly illustrating the other condition of use of the apparatus.

FIG. 4 shows the other condition for use contrasted with that shown in FIG. 2. In this condition of use, the grinding wheel G and the driven pulley, not shown, are mounted respectively upon the right and left ends of the wheel spindle. The wheel guard 13 is also removed from the left side (FIG. 2) of the wheel head 10, being moved to the right side, and is threadedly fixed in the same manner as above, through the bracket 14 and the spacer 15. In this event, the second rejection pin 40 is penetrated through another positioning guide slot 38*b*, which is formed on the left lateral plate 13*b* of the guard assembly 13, symmetrically with the positioning guide slot 38*a*. The motor base, not shown, is turned through an angle of 180°, together with the electric motor 19, and is guided by another reference surface, not shown, which is formed at the rear-left side portion of the wheel head 10, symmetrically with the aforementioned reference surface 22.

In addition, the support rod 44 is threadedly fixed on the support block 31 fixed upon the left side of the wheel head 10 and supports the pulley cover assembly. The first rejection pin, in this condition of use, is inserted into the engaging hole of the slide cover plate 43, and it is, therefore, noted that the first and second rejection pins 37, 40, in this condition of use, are mutually replaced in function by those in the condition of use as shown in FIG. 2. For this reason, it is possible also, in this condition of use, to achieve the same function and effectiveness as mentioned previously. Furthermore, as the slide cover plate 43 is disposed to lie on a line connecting the pulley 12 with the pulley 17, even when the cover assembly 41 is being attached to any side of the wheel head 10, the proper positional relationships between the restraining pin 46 and the drive pulleys 17, 17*a* and between the engaging hole of the cover plate 43 and the rejection pins 37, 40 are maintained.

As is clear from the above explanation, the present invention provides apparatus for preventing circumferential overspeeding of a grinding wheel, in which the slide plate 43, guided by the cover device 41, is engaged with one of the members 37, 40 to move the restraining member 46 into and from such a space as to be occupied by the drive pulley with a large diameter d1 being on the drive motor 19. The apparatus according to the present invention, therefore, has good harmonization with the cover device 41, and this further advantageously permits the use of such a closed type cover device as is composed of the inner and outer covers 41*a*, 41*b*, so that safeness in the grinding operation can be more enhanced.

Furthermore, as the restraining member 46 is spaced a predetermined distance L0 from the engaging hole of the slide plate 43 toward the drive pulley 17, the apparatus and, particularly, its link mechanism 30–36 can be small sized as a whole.

In addition, the slide plate 43 is disposed to be slidable on a line connecting the driven pulley 12 with the drive pulley 17, even when the cover device 41 is being attached to any side of the wheel head 10. Therefore, the apparatus can be employed in a so-called universal grinding machine because the same effect is obtained whether the functions of the members 37, 40 against the grinding wheel G and against the slide plate 43 are mutually exchanged or not.

Obviously many modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. In an apparatus for preventing circumferential overspeeding of a grinding wheel in a grinding machine having a wheel head, a wheel spindle rotatably supported upon said wheel head for mounting said grinding wheel and a driven pulley at both ends thereof, a drive motor adapted to have first and second drive pulleys alternatively mounted thereon, said second drive pulley having a diameter larger than that of said first drive pulley, and belt means for drivingly connecting said drive pulley on said drive motor with said driven pulley, the improvement comprising:

means for providing slot means extended radially of said grinding wheel and defining thereon retraction and forward positions corresponding, respectively, to first and second diameters of said grinding wheel;

a cover device for accommodating said drive pulley on said drive motor, said driven pulley and said belt means;

a slide plate guided by said cover device and slidable radially of said drive pulley on said drive motor;

a first member perforated through said slot means to be opposed to the circumferential surface of said grinding wheel;

a second member engaged with said slide plate to be moved radially of said drive pulley on said drive motor together with said slide plate;

a link mechanism provided upon said wheel head for linking said first member with said second member; and a restraining member provided upon said slide plate to be moved by said link mechanism into such a space as to be occupied by said second drive pulley on said drive motor when said first member is retracted from said forward position to said retract position within said slot means.

2. An apparatus as claimed in claim 1, wherein said second member is perforated through an engaging hole formed upon said slide plate and wherein said restraining member is spaced a predetermined distance toward said drive pulley, on said drive motor, from said engaging hole.

3. An apparatus as claimed in claim 2, wherein said cover device is attachable to any one of lateral portions of said wheel head and wherein said slide plate is disposed to be slidable on a line connecting said wheel spindle with said drive pulley on said drive motor.

4. An apparatus as claimed in claim 3, wherein said cover device is of a closed type comprising an inner cover and an outer cover and wherein said slide plate is guided by said inner cover.

5. An apparatus as claimed in claim 4, wherein said means for providing said slot means is a wheel guard device attachable to any one of said lateral portions of said wheel head in a complemental relationship with said cover device for covering said grinding wheel, and wherein said slot means comprises a pair of guide slots opened, respectively, upon two lateral plates of said wheel guard device.

6. An apparatus as claimed in claim 5, wherein said first and second members are rejection pins, each adapted to be perforated through one of said guide slots and said engaging hole.

7. An apparatus as claimed in claim 6, wherein said link mechanism is constructed to move any one of said rejection pins to such a position as to be engageable with said engaging hole when the other of said rejection pins is perforated through one of said guide slots.

8. An apparatus as claimed in claim 7, wherein each of said guide slots is an arcuate slot capable of positioning said rejection pins at forward and retract extreme ends thereof and of guiding said rejection pins therebetween.

* * * * *